US008439536B2

(12) United States Patent
Sato et al.

(10) Patent No.: US 8,439,536 B2
(45) Date of Patent: May 14, 2013

(54) VEHICLE HEADLIGHT

(75) Inventors: Takashi Sato, Tokyo (JP); Masafumi Ohno, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 263 days.

(21) Appl. No.: 13/071,494

(22) Filed: Mar. 24, 2011

(65) Prior Publication Data

US 2011/0235356 A1 Sep. 29, 2011

(30) Foreign Application Priority Data

Mar. 24, 2010 (JP) ..... 2010-067260

(51) Int. Cl.
*F21V 7/00* (2006.01)

(52) U.S. Cl.
USPC ..... 362/510; 362/545; 362/516; 362/249.02

(58) Field of Classification Search ..... 362/510, 362/545, 516, 249.02, 311.01
See application file for complete search history.

(56) References Cited

U.S. PATENT DOCUMENTS

| | | | | |
|---|---|---|---|---|
| 6,855,958 | B2 | 2/2005 | Sato et al. | |
| 7,520,647 | B2 | 4/2009 | Tachibana | |
| 2003/0160255 | A1 | 8/2003 | Taninaka et al. | |
| 2004/0196663 | A1* | 10/2004 | Ishida et al. | 362/539 |
| 2006/0197101 | A1 | 9/2006 | Wu | |
| 2007/0247847 | A1 | 10/2007 | Villard | |
| 2008/0303038 | A1 | 12/2008 | Grotsch et al. | |
| 2009/0034277 | A1* | 2/2009 | Okada | 362/509 |
| 2009/0257240 | A1* | 10/2009 | Koike | 362/538 |
| 2010/0315828 | A1* | 12/2010 | Yatsuda et al. | 362/521 |

FOREIGN PATENT DOCUMENTS

| | | | |
|---|---|---|---|
| JP | 2004-140090 | A | 5/2004 |
| JP | 2005-276805 | A | 10/2005 |
| JP | 2008-513967 | A | 5/2008 |
| WO | 2006/034329 | A2 | 3/2006 |

* cited by examiner

*Primary Examiner* — Evan Dzierzynski
(74) *Attorney, Agent, or Firm* — Kenealy Vaidya LLP

(57) ABSTRACT

A vehicle light can include a matrix type semiconductor light source, an imaging lens and a reflector. The light source can project an enlarged matrix light on the reflector via the imaging lens. The reflector can include a matrix reflex surface having horizontal curvatures. Each of the horizontal curvatures of the reflex surfaces arranged in columns can be configured such that the corresponding column light is extended gradually in a wider range as the corresponding column light approaches from a central column light toward both edge column lights. Accordingly, a magnification of light projected from the reflector can become gradually large as approaching from the central column toward both edge columns. Thus, the disclosed subject matter can provide vehicle headlights that can form favorable light distribution patterns for a low beam and a high beam having a bright central portion in a wide range of a smooth light distribution pattern.

20 Claims, 6 Drawing Sheets

VEHICLE HEADLIGHT

This application claims the priority benefit under 35 U.S.C. §119 of Japanese Patent Application No. 2010-067260 filed on Mar. 24, 2010, which is hereby incorporated in its entirety by reference.

BACKGROUND

1. Field

The presently disclosed subject matter relates to vehicle lights and headlights using a matrix type semiconductor light source, and more particularly to vehicle headlights using a matrix type semiconductor light source that can provide a favorable light distribution pattern, which includes a central portion having high brightness in a wide range of light distribution pattern.

2. Description of the Related Art

Vehicle headlights that include a plurality of LED chips as a light source to form a light distribution pattern having high brightness have been developed in recent years. The vehicle headlights can be classified into two major groups: a reflector type headlight; and a projector type headlight. A conventional LED light source using a plurality of LED chips and a vehicle headlight using the light source, for example, are disclosed in Patent Document No. 1 (co-owned U.S. Pat. No. 7,520,647). The conventional LED light source disclosed in Patent Document No. 1 can be used as a light source for a reflector type headlight.

When the conventional LED light source is used for a vehicle headlight, the headlight may form a predetermined light distribution pattern by reflecting light emitted from the LED light source by a reflector. When a light distribution pattern for a low beam is formed by the LED light source and the reflector, the vehicle headlight may form a light distribution pattern for a low beam including a horizontal cut-off line by using a shade to shield an upward light that gives a glaring type light to an oncoming vehicle and the like.

On the other hand, a conventional vehicle headlight using a plurality of LEDs that can be used as a light source for a projector type headlight is disclosed in Patent Document No. 2 (Japanese Patent Application Laid Open JP2008-513967). FIG. 6*a* is a schematic side view showing the conventional vehicle headlight disclosed in Patent Document No. 2, and FIG. 6*b* is a close-up top view showing a light source array 51 of the vehicle headlight of FIG. 6*a*.

The conventional vehicle headlight includes: a plurality of LEDs; light source array 51 composed of a plurality of optical fibers and guiding light emitted from the LEDs; and a projector lens 50 projecting the light emitted from the LEDs and guided by the light source array 51. The light source array 51 includes a first light source array 51*a* forming a light distribution pattern for a low beam and a second light source array 51*b* forming a light distribution pattern for a high beam along with the first light source array 51*a*.

When the conventional vehicle headlight forms a light distribution pattern for a low beam, light projected by the first light source array 51*a* flips via the projector lens 50 and may be emitted in a light-emitting direction of the vehicle headlight as the light distribution pattern for a low beam. When the vehicle headlight forms a light distribution pattern for a high beam, light projected by the first and the second light source arrays 51*a* and 51*b* flips via the projector lens 50 and may be emitted in the light-emitting direction of the vehicle headlight as the light distribution pattern for a high beam including an upward light, which is projected by the second light source array 51*b*.

Accordingly, this conventional headlight may form light distribution patterns for a low beam and a high beam without a reflector or shade, which are provided in the conventional reflector type headlight. In this case, a density of a central portion of the light source array 51 may become high and a density of right and left sides may become low, so that central portions of the light distribution patterns for a low beam and a high beam can include brighter regions as compared to the right and left sides.

However, because the light distribution patterns for a low beam and a high beam may be reflected directly by the light-emitting location of the optical fibers and the light intensity distribution of the light source array 51, dark portions may occur between the adjacent optical fibers located near the right and left sides of the light source array 51 and therefore, may cause dark portions on the light distribution patterns. Thus, it may be difficult for the conventional headlight to form a smooth light distribution pattern. In addition, it may be difficult for the conventional headlight to form a wide range of light distribution pattern due to use of the projector lens 50.

Moreover, when each of the optical fibers of the light source array 51 is coupled with each of the plurality of LEDs, the number of LEDs and the number of couplers between the optical fibers and the plurality of LEDs may not only increase, but a light distributing structure for the light source array 51 may also become large. When some of the optical fibers of the light source array 51 are coupled with each of the plurality of LEDs, the light distributing structure for the light source array 51 may become complex although the number of LEDs may diminish. Furthermore, a rugged high quality clamping device for use with the light source array 51 may be required for preventing the optical fibers from vibrating. Thus, use of the light source array 51 including the optical fibers may result in a high cost conventional headlight.

The above-referenced Patent Documents are listed below, and are hereby incorporated with their English abstracts in their entireties.

1. Patent Document No. 1: U.S. Pat. No. 7,520,647.
2. Patent Document No. 2: Japanese Patent Application Laid Open JP2008-513967 (WO2006/034329).

The disclosed subject matter has been devised to consider the above and other problems, features, and characteristics. Thus, embodiments of the disclosed subject matter can include vehicle lights, and headlights that can form a favorable light distribution pattern for a high beam, which includes a central portion having high brightness in a wide range of smooth light distribution pattern and without the need for optical fibers. The disclosed subject matter can also include a reflector type headlight using a matrix type semiconductor light source that can form a favorable light distribution pattern for a low beam having a wide light-emitting area and a brighter central portion without the use of a shade and/or optical fibers.

SUMMARY

The presently disclosed subject matter has been devised in view of the above and other problems, features, and characteristics. Another aspect of the disclosed subject matter includes vehicle headlights using a matrix type semiconductor light source and a simple parabolic reflector that can provide favorable light distribution patterns for a low beam and a high beam having a brighter central portion in a wide range of the light-emitting area, while enjoying low cost in comparison with the conventional vehicle headlight.

According to an aspect of the disclosed subject matter, a vehicle headlight can include: a semiconductor light source including a plurality of semiconductor light-emitting chips; an imaging lens; and a reflector including a plurality of reflex surfaces. The plurality of semiconductor light-emitting chips can be located adjacent a base board of the semiconductor light source and can be arranged in a matrix so that the semiconductor light-emitting chips can emit a matrix light including a central column light and both edge column lights. Each of the semiconductor light-emitting chips can be encapsulated with an encapsulating resin. An incoming surface of the imaging lens can be located adjacent the semiconductor light source so that the imaging lens enlarges each element light of the matrix light emitted from the semiconductor light source.

In addition, the plurality of reflex surfaces can be located adjacent an outgoing surface of the imaging lens and can be arranged in a matrix so as to receive each element light of the matrix light enlarged by the imaging lens from the outgoing surface of the imaging lens. Each of the reflex surfaces can have a vertical curvature and a horizontal curvature, and each of the vertical curvatures of the reflex surfaces arranged in rows can be substantially the same with respect to each other. Each of the horizontal curvatures of the reflex surfaces arranged in columns can be also substantially the same with respect to each other and can be configured such that the corresponding column light of the matrix light is horizontally extended gradually in a wider range as the corresponding column light approaches from the central column light toward the both edge column lights. In this case, each of the reflex surfaces can be configured with a free surface base upon at least of an arc curved line, a conical curved line, a spline curve, Bezier surface.

In the above-described exemplary vehicle headlight, the matrix light emitted from the semiconductor light source can include at least one lighting mode of a headlight for a low beam, a headlight for a high beam and a daytime running light. In the case, the encapsulating resin can continuously encapsulate a region of the plurality of semiconductor light-emitting chips that constructs the at least one lighting mode of the headlight for a low beam, the headlight for a high beam and the daytime running light. Each of the vertical curvatures of the reflex surfaces arranged in rows can also be configured such that the corresponding reflex surfaces arranged in rows convert the corresponding row light of the matrix light enlarged by the imaging lens into a substantially parallel light in a vertical direction.

Moreover, a light intensity of the central column light reflected on the reflector can be thirty times or more a light intensity of both edge column lights reflected on the reflector. Each of the semiconductor light-emitting chips can be a blue light-emitting chip and the encapsulating resin can include a wavelength converting material that is selected from the group consisting of a yellow phosphor, and two phosphors of a red phosphor and a green phosphor. Each of the semiconductor light-emitting chips can be also an ultraviolet light-emitting chip and also the encapsulating resin can include a wavelength converting material including at least one of a red phosphor, a green phosphor and a blue phosphor. The vehicle headlight can further include an outer lens located adjacent the reflector and passing the matrix light reflected on the reflector, and a casing located adjacent the outer lens so as to cover the reflector, the imaging lens and the semiconductor light source along with the outer lens.

According to the above-described exemplary vehicle headlight, the reflector of the headlight can include each of the horizontal curvatures of the reflex surfaces arranged in columns, which can be configured such that the corresponding column light is horizontally extended gradually in a wider range as the corresponding column light approaches from the central column light toward the both edge column lights. Accordingly, each of projecting magnifications in columns of matrix lights for a low beam and a high beam projected from the reflector can become gradually large as the corresponding column approaches from the central column light toward the both edge column lights. Thus, the disclosed subject matter can provide vehicle headlights that can form favorable light distribution patterns for a low beam and a high beam, which include a central portion having high brightness in a wide range of smooth light distribution pattern.

Another aspect of the disclosed subject matter, a vehicle headlight can include a semiconductor light source including a plurality of semiconductor light-emitting chips located adjacent a base board and arranged in a matrix including a central column and a central row so that the light-emitting chips emits a matrix light, and each of the light-emitting chips encapsulated with an encapsulating resin, and an imaging lens having an optical axis and an imaging point located on the optical axis opposite an incoming surface, the optical axis intersecting with the central column of the semiconductor light source at a substantially right angle with respect to the central row, and the incoming surface located adjacent the semiconductor light source so that the imaging lens focuses the matrix light including a central column light and both edge column lights emitted from the semiconductor light source at the imaging point.

Additionally, the vehicle headlight can include a parabolic reflector including an optical axis and a focus located on the optical axis, the focus located substantially at the imaging point of the imaging lens, the optical axis of the parabolic reflector being located on a virtual co-planar surface including the central column of the semiconductor light source and the optical axis of the imaging lens, wherein a horizontal curvature of the parabolic reflector is configured such that a column light of the matrix light is horizontally extended gradually in a wider range as the column light approaches from the central column light toward the both edge column lights.

In the above-described exemplary vehicle headlight, the same or similar variations of the headlight can also be employed as set forth in paragraphs [0016]-[0017].

According to an exemplary vehicle headlight, the parabolic reflector of the headlight can also include a horizontal curvature, which can be configured such that a column light of the matrix light is horizontally extended gradually in a wider range as the column light approaches from the central column light toward both edge column lights. Thus, the disclosed subject matter includes vehicle headlights using a matrix type semiconductor light source and a simple reflector that can provide favorable light distribution patterns for a low beam and a high beam having a brighter central portion in a wide range of light-emitting area.

BRIEF DESCRIPTION OF THE DRAWINGS

These and other characteristics and features of the disclosed subject matter will become clear from the following description with reference to the accompanying drawings, wherein.

DETAILED DESCRIPTION OF EXEMPLARY EMBODIMENTS

Figure 1:
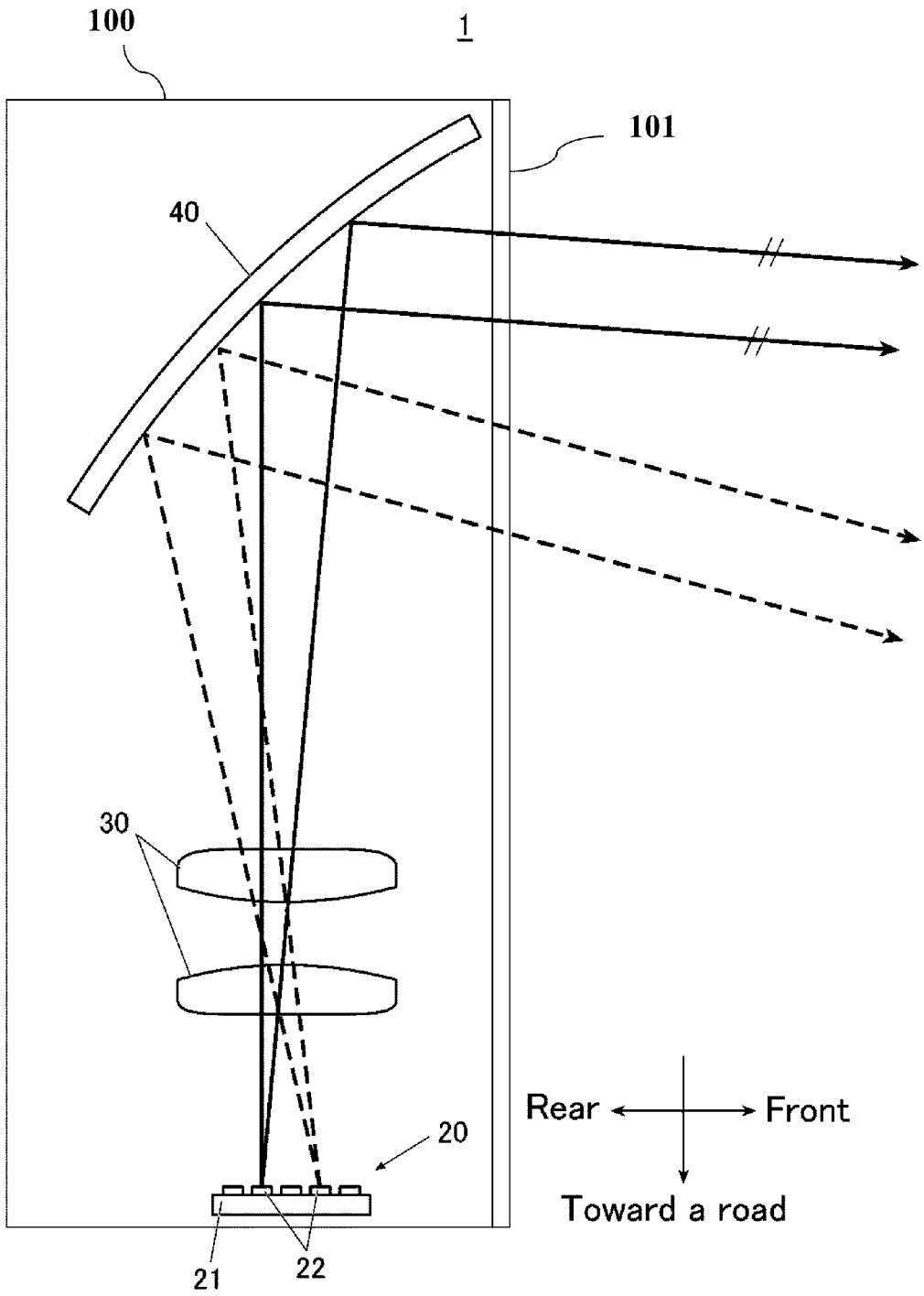
FIG. 1 is a schematic side cross-section view showing an exemplary embodiment of a vehicle headlight made in accordance with principles of the disclosed subject matter.

Exemplary embodiments of the disclosed subject matter will now be described in detail with reference to FIGS. 1 to 5. FIG. 1 is a schematic side cross-section view showing an exemplary embodiment of a vehicle headlight made in accordance with principles of the disclosed subject matter. The vehicle headlight 1 can include: a semiconductor light source 20 located closer to a road of travel for a vehicle; an imaging lens 30 located over the semiconductor light source 20 and enlarging light emitted from the semiconductor light source 20; and a reflector 40 located over the imaging lens 30 so that light enlarged by the imaging lens 30 is reflected in a forward direction of the vehicle.

The vehicle headlight 1 can further include a casing 100 and an outer lens 101, which are shown in schematic form in FIG. 1. The semiconductor light source 20, the imaging lens 30 and the reflector 40 can be attached to the casing 100 having an opening that passes light reflected by the reflector 40 in a light-emitting direction of the vehicle headlight 1. The outer lens 101 can be attached to the opening of the casing 100 so as to pass the light reflected from the reflector 40 in a light-emitting direction of the vehicle headlight 1. In addition, the semiconductor light source 20, the imaging lens 30 and the reflector 40 can be protected against external environmental conditions, such as rain, wind, dirt and the like by being surrounded with the casing 100 and outer lens 101.

The semiconductor light source 20 can include a plurality of semiconductor light-emitting devices 22 located adjacent a base board 21, and the plurality of light-emitting devices 22 can be arranged in a matrix on the base board 21 so as to emit a matrix light as will be described in more detail below. Each of the elemental light portions of the matrix light emitted from the semiconductor light source 20 can be enlarged at a predetermined magnification by the imaging lens 30, and can be projected on the reflector 40 in the form of the matrix light. The reflector 40 can reflect each of the elemental light portions of the matrix light enlarged by the imaging lens 30 in the light-emitting direction of the vehicle headlight 1.

Figure 2:
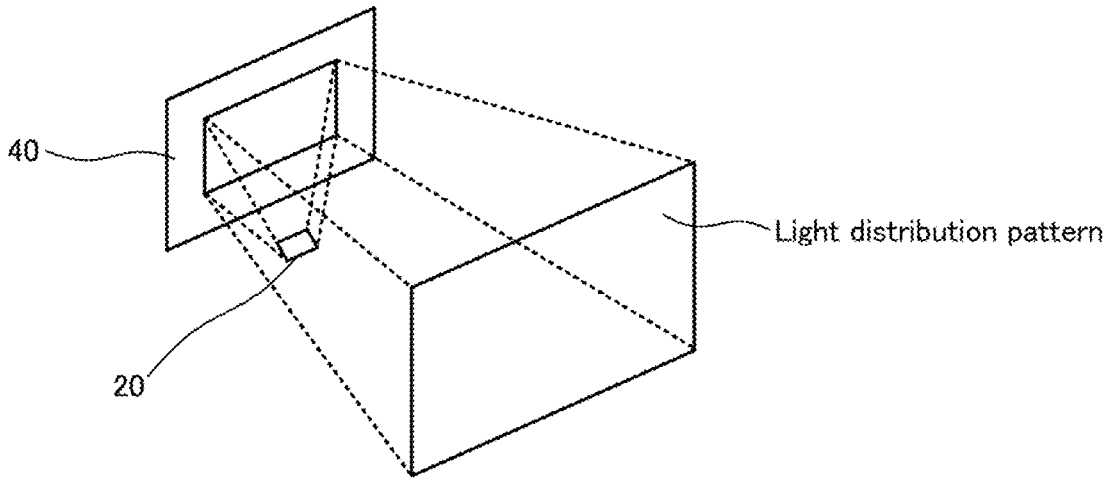
FIG. 2 is an perspective view depicting a principle of the disclosed subject matter, wherein an imaging lens is abbreviated.

FIG. 2 is an explanatory perspective view depicting a principle of the disclosed subject matter, wherein the imaging lens 30 is abbreviated to facilitate visualization. As shown in FIG. 2, the matrix light emitted from the semiconductor light source 20 can be directly enlarged and can be projected on the reflector 40 in the form of the matrix light. The enlarged matrix light can be further enlarged in the form of the matrix light and can be directly formed as a light distribution pattern by the reflector 40.

Figure 3:
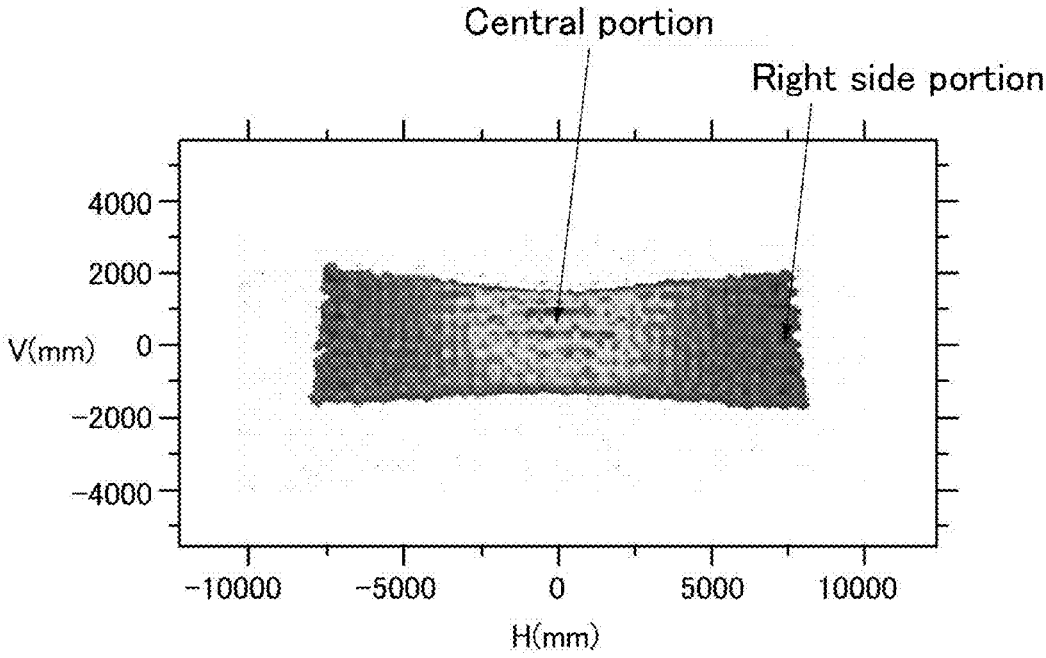
FIG. 3 is a diagram showing a light distribution pattern by a computer simulation using the vehicle headlight of FIG. 1.

FIG. 3 is a diagram showing a light distribution pattern by a computer simulation using the vehicle headlight 1 of FIG. 1, and the light distribution pattern is formed on a vertical screen which is located at 25 meters away from the vehicle headlight 1. The vehicle headlight 1 can provide a favorable light distribution pattern for a high beam, which can illuminate a wide range of right and left sides while including a central portion having high brightness.

As shown in FIG. 3, because the vehicle headlight 1 can illuminate a wide area between approximately 75 meters away from the central portion in a right and left direction, the vehicle headlight 1 can provide a very wide range of view for a driver. Furthermore, the vehicle headlight 1 can provide a high forward visibility for a driver because of the central portion having high brightness in the wide light distribution pattern.

Figure 4:
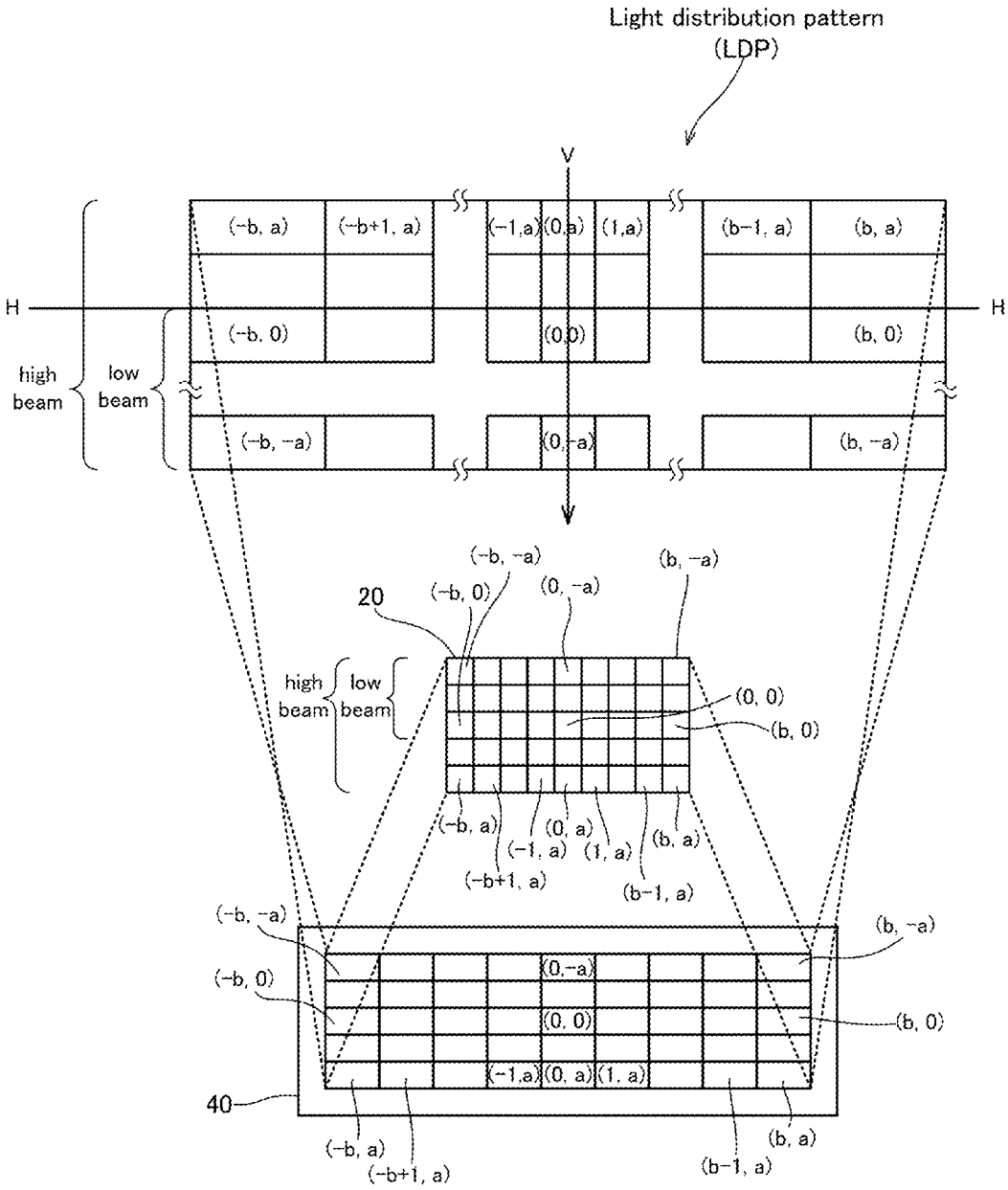
FIG. 4 is an explanatory development view depicting a light-emitting structure of a light distribution pattern formed in accordance with the principle of FIG. 2.

A principle of the disclosed subject matter will now be described in detail with reference to FIG. 4. FIG. 4 is an explanatory development view depicting a light-emitting structure of a light distribution pattern formed in accordance with the principle of FIG. 2. The semiconductor light source 20 can include a first row from (−b, a) to (b, a), a last row from (−b, −a) to (b, −a) and both edge columns, which are a first column from (−b, a) to (−b, −a) and a last column from (b, a) to (b, −a).

A central axis in columns of the semiconductor light source 20 can be located on a central column from (0, a) to (0, −a), and a central axis in rows of the semiconductor light source 20 can be located on a central row from (−b, 0) to (b, 0). Each of the elemental light portions of the matrix light emitted from the semiconductor light source 20 can be projected on the reflector 40 in the form of the matrix light while being enlarged at the predetermined magnification on the reflector 40 via the imaging lens 30.

Therefore, a matrix light projected on the reflector 40 can include a first row from (−b, a) to (b, a), a last row from (−b, −a) to (b, −a) and both edge columns, which are a first column from (−b, a) to (−b, −a) and a last column from (b, a) to (b, −a) of the reflector 40. The first row from (−b, a) to (b, a) of the reflector 40 can be located at a top position of the reflector 40, and the last row from (−b, −a) can be located at a bottom position of the reflector 40. The reflector 40 can include a plurality of reflex free surfaces based upon at least one of an arc curved line, a conical curved line, a spline curve, Bezier surface and the like so that the matrix light can form a light distribution pattern for a high beam. The reflex free surfaces can also be formed in a matrix, as well as the semiconductor light source 20.

Each of the free surfaces can include a vertical curvature and a horizontal curvature. Each of the vertical curvatures of the free surfaces arranged in rows of the reflector 40 can be substantially the same with respect to each other (e.g. the first row, the last row), and can be configured to reflect the corresponding row light of the matrix light as a substantially parallel light in a vertical direction as shown in FIG. 1. Each of the horizontal curvatures of the free surfaces arranged in columns can also be the same with respect to each other (e.g. the first column, the last column), and also can be configured to reflect the corresponding column light of the matrix light in a wide range as a diffusing light in a horizontal direction.

In addition, each of the horizontal curvatures of the free surfaces arranged in columns can become larger so as to diffuse the corresponding column light of the matrix light gradually in a wider range in a horizontal direction as the corresponding column approaches from the central column toward the first and the last columns of both edge columns. More specifically, each of the horizontal curvatures of the free surfaces for the central column from (0, a) to (0, −a) of the reflector 40 can become small so that the central column light is not extended in a wide range on the central column of the reflector 40. In contrast, each of the horizontal curvatures of the free surfaces for the first column from (−b, a) to (−b, −a)

and the last column from (b, a) to (b, −a) can become large so that both edge column lights can be extended in a wider range on the first and last columns of the reflector 40.

Thus, the first column from (−b, a) to (−b, −a) and the last column from (b, a) to (b, −a) of the semiconductor light source 20 can be relatively enlarged and can be projected on the light distribution pattern (LDP) shown in FIG. 4. That is to say, the closer a column of the semiconductor light source 20 is toward the central column from (0, a) to (0, −a), the smaller a magnification ratio of the element light in the matrix light projected on LDP is. Therefore, the central column from (0, a) to (0, −a) of the semiconductor light source 20 can be enlarged at the smallest magnification ratio and can be projected to LDP.

Thereby, on the central column from (0, a) to (0, −a) of LDP, the vehicle headlight 1 can illuminate the column light of the central column of the semiconductor light source 20 as the relatively brightest portion. In addition, in a wide range between the first column from (−b, a) to (−b, −a) of LDP and the last column from (b, a) to (b, −a) of LDP, the vehicle headlight 1 can widely illuminate the matrix light of the semiconductor light source 20, because the magnification ratio in columns projected from the reflector 40 becomes larger as the column approaches from the central column of the reflector 40 toward the both edge columns, which are the first column and the last column of the reflector 40.

Moreover, a light distribution pattern that becomes gradually darker as approaching from the central column between (0, a) and (0, −a) of LDP to the first column between (−b, a) and (−b, −a) of LDP and to the last column between (b, a) and (b, −a) of LDP can be formed by the vehicle headlight 1. For example, a light intensity on the central column of LDP can become from 30 times to 100 times a light intensity of the first and the last columns of LDP. Furthermore, because each of the vertical curvatures of the free surfaces located in rows can be substantially the same with respect to each other and also each of the horizontal curvatures of the free surfaces located in columns can be substantially the same with respect to each other, the vehicle headlight 1 can provide a smooth light distribution pattern without the dark portions in comparison with the conventional headlight.

The above-described light distribution pattern can be used for a high beam and a daytime running light. When the vehicle headlight 1 is used for the high beam and the daytime running light, the vehicle headlight 1 can be powered by a normal electric current applied to the semiconductor light-emitting devices 22 when operated at high beam, and by a relatively smaller electric current applied to the semiconductor light-emitting devices 22 when operated as a daytime running light.

When a light distribution pattern for a low beam, a fog lamp and the like without an upward light that possibly gives a glaring type of light to an oncoming car is formed by the vehicle headlight 1, the light distribution pattern for a low beam between the central row located under a horizontal line of LDP and the last row of LDP can be formed by emitting matrix light between the central row from (−b, 0) to (b, 0) and the last row from (−b, −a) to (b, −a) of the semiconductor light source 20. Accordingly, the vehicle headlight 1 can include at least one lighting mode for a high beam, a low beam, and a daytime running light by the semiconductor light source 20, which can emit a substantially white light.

The above-described embodiment is described regarding a case where the semiconductor light source 20 is substantially rectangular to ease an understanding of the disclosed subject matter. When the light distribution pattern for a high beam is formed in an ellipsoidal shape and when the light distribution pattern for a low beam is formed in a semi-ellipsoidal shape, the embodiment can be similarly used by forming the matrix light of the semiconductor light source 20 in a substantially ellipsoidal shape. Of course, other shapes can also be used for the semiconductor light source 20, depending on particular application and particular vehicle structure.

In addition, the embodiment is also described with respect to a case where the matrix of the semiconductor light source 20 is lattice-shaped. However, the matrix of the semiconductor light source 20 can be formed in other shapes, including in a houndstooth shape or in an unequally-spaced shape. These embodiments can similarly include a plurality of free surfaces for the reflector 40 so that each of the free surfaces corresponds to each of the element lights of the matrix light of the semiconductor light source 20.

Each of the semiconductor light-emitting devices 22 can be composed of a semiconductor light-emitting chip and a transparent resin encapsulating the semiconductor light-emitting chip. When the vehicle headlight 1 is used as a fog lamp, an amber LED chip can be used as the semiconductor light-emitting chip and a silicone resin can be used as the transparent resin. When white light is emitted from the vehicle headlight 1 for a high beam, a low beam and the like, a blue LED chip having a peak wavelength of 460 nanometers can be used as the semiconductor light-emitting chip. In this case, the transparent resin can include a wavelength converting material including a yellow phosphor, which can emit a yellow light by excitement by blue light emitted from the blue LED chip.

The semiconductor light-emitting device 22 including the blue LED chip and the yellow phosphor can emit substantially white light by additive color mixture of the excited yellow light emitted from the yellow phosphor and a part of the blue light emitted from the blue LED chip. The yellow phosphor can include $Y_3Al_5O_{12}:Ce^{3+}$ (YAG), $(Sr, Ba)_2SiO_4:Eu^{2+}$, $Ca_x(Si, Al)_{12}(O, N)_{16}:Eu^{2+}$ and the like. In place of the yellow phosphor, a red phosphor for wavelength-converting the blue light emitted from the blue LED chip into red-purple light and a green phosphor for wavelength-converting the blue light into blue-green light can also be used.

In this case, the semiconductor light-emitting device 22 including the blue LED chip, the red phosphor and the green phosphor can also emit light having substantially white light by additive color mixture of the red-purple light that is excited by the blue light, the blue-green light emitted from the green phosphor and a part of the blue light. The red phosphor can include $CaAlSiN_3:Eu^{2+}$, $Ca_2Si_5N_8:Eu^{2+}$, $La_2O_2S:Eu^{3+}$, $KSiF_6:Mn^{4+}$, $KTiF_6:Mn^{4+}$ and the like. $Y_3(Ga, Al)_5O_{12}:Ce^{3+}$, $Ca_3Sc_2Si_3O_{12}:Ce^{3+}$, $CaSc_2O_4:Eu^{2+}$, $(Ba, Sr)_2SiO_4:Eu^{2+}$, $Ba_3Si_6O_{12}N_2:Eu^{2+}$, $(Si, Al)_6(O, N):Eu^{2+}$ and the like can be used as the green phosphor.

An LED of InGaN series that emits near-ultraviolet light having a wavelength of approximately 380 nanometers, a laser diode that emits ultraviolet light and the like can also be used in place of the blue LED chip. In this case, in order to emit the substantially white light, the transparent resin can include: a red phosphor for wavelength-converting the ultraviolet light into red light; a green phosphor for wavelength-converting the ultraviolet light into green light; and a blue phosphor for wavelength-converting the ultraviolet light into blue light.

$CaAlSiN_3:Eu^{2+}$, $Ca_2Si_5N_8:Eu^{2+}$, $La_2O_2S:Eu^{3+}$, $KSiF_6:Mn^{4+}$, $KTiF_6:Mn^{4+}$ and the like can be used as the red phosphor. $(Si, Al)_6(O,N):Eu^{2+}$, $BaMgAl_{10}O_{17}:Eu^{2+}Mn^{2+}$, $(Ba, Sr)_2SiO_4:Eu^{2+}$ and the like can be used as the green phosphor. $(Sr, Ca, Ba, Mg)_{10}(PO_4)_6Cl_2:Eu^{2+}$, $BaMgAl_{10}O_{17}:Eu^{2+}$, $LaAl(Si, Al)_6(N,O)_{10}:Ce^{3+}$ can be used as the blue phosphor. When yellow light is emitted by the ultraviolet light for the fog lamp, the yellow light may also be emitted by the red phosphor and the green phosphor along with the ultraviolet light.

The semiconductor light-emitting devices 22 including the semiconductor light-emitting chip and the encapsulating resin can be formed in various shapes such as a rectangular shape, a circular shape, etc. In these cases, each of the semiconductor light-emitting devices 22 can be formed as an individual LED, and a region of the semiconductor light-emitting devices 22 can also be formed as one matrix LED by continuously encapsulating a plurality of semiconductor light-emitting chips with the encapsulating resin. More specifically, when the region of the semiconductor light-emitting chips used for a low beam is continuously encapsulated with the encapsulating resin, the light distribution pattern for a low beam can become smoother than that formed by a plurality of individual separated light-emitting devices.

Figure 5:
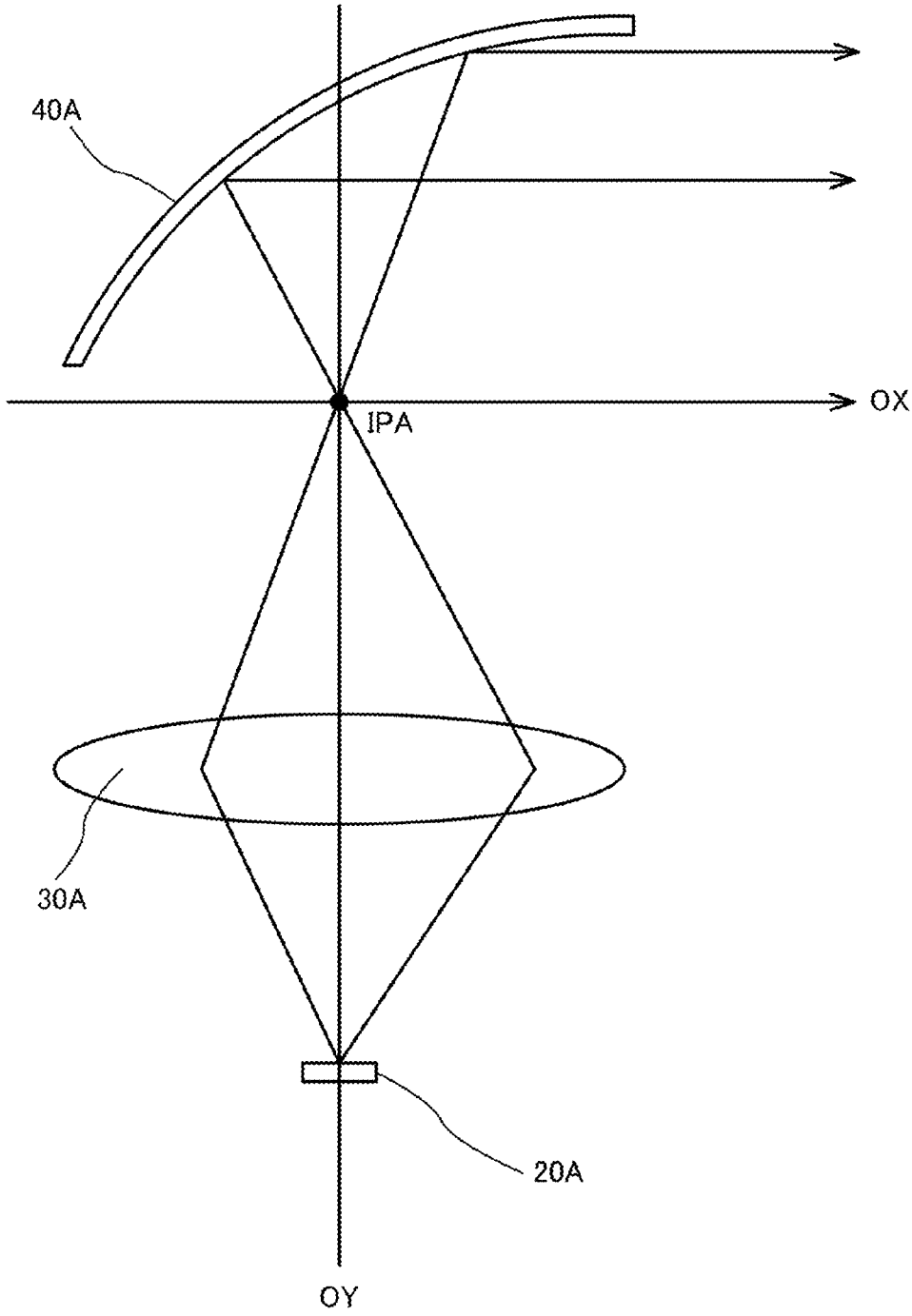
FIG. 5 is a schematic side cross-section view showing an exemplary variation of the vehicle headlight of FIG. 1.
Figure 6A:
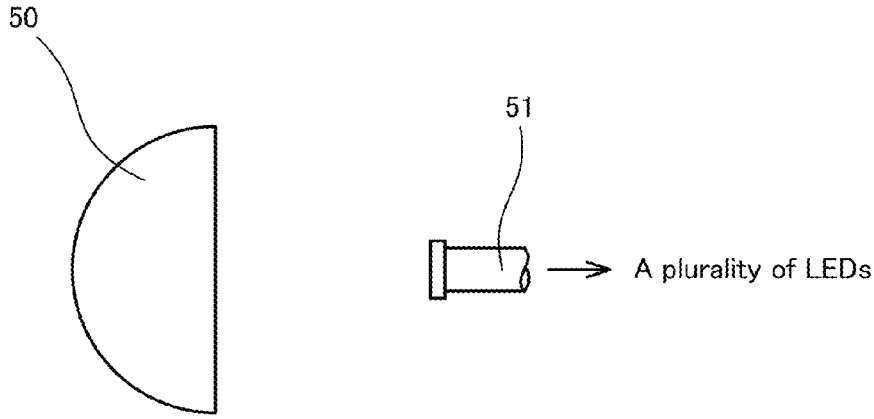
FIG. 6a Conventional Art
FIG. 6*a* is a schematic side view showing a conventional vehicle headlight.
Figure 6B:
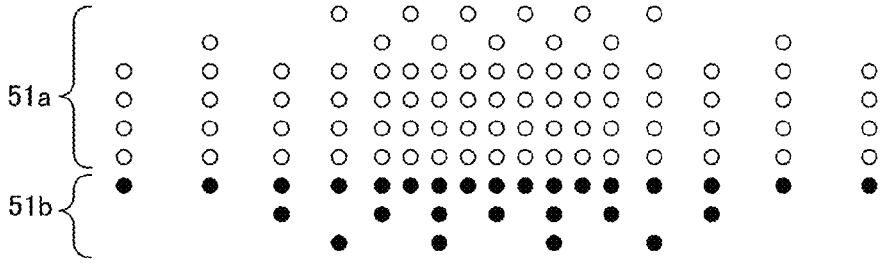
FIG. 6b Conventional Art
FIG. 6*b* is a close-up top view showing a light source array for the vehicle headlight of FIG. 6*a*.

An exemplary variation of the vehicle headlight 1 will now be described. FIG. 5 is a schematic side cross-section view showing an exemplary variation of the vehicle headlight of FIG. 1. In the variation, a semiconductor light source 20A can be located on an optical axis OY of an imaging lens 30A so that matrix light of the semiconductor light source 20A faces an imaging lens 30A while the optical axis OY intersects with a central element (0, 0) located on the central column from (0, a) to (0, −a) of the semiconductor light source 20A at a substantially right angle with respect to the central row from (−b, 0) to (b, 0).

In this case, after the matrix light of the semiconductor light source 20A focuses at an imaging point IPX via the imaging lens 30A, the matrix light can be projected on a reflector 40A. Accordingly, the matrix light of the semiconductor light source 20A can form light distribution patterns for a low beam and a high beam via the plurality of free surfaces of the reflector 40 in accordance with the principle shown in FIG. 4.

However, a reflector 40A can be composed of a simple parabolic reflex surface having an optical axis OX and a focus located on the optical axis OX in place of the reflector 40 which includes the plurality of free surfaces. In this case, when the parabolic reflector 40A is located so that the focus of the parabolic reflector 40A is located at the imaging point IPA, the matrix light emitted from the semiconductor light source 20A can be emitted as a substantially parallel light with respect to the optical axis OX from the parabolic reflector 40A.

In addition, when the optical axis OX of the parabolic reflector 40A is located on a virtual co-planar surface including the central column of the semiconductor light source 20A and the optical axis OY of the imaging lens 30, the matrix light emitted from the semiconductor light source 20A can be projected on the parabolic reflector 40A as a symmetrical matrix light with respect to the optical axis OX of the parabolic reflector 40A.

Accordingly, a horizontal curvature of the parabolic reflector 40A can be configured such that a column light of the matrix light is horizontally extended gradually in a wider range as the column light approaches from the central column light toward the both edge column lights, and thereby the above-described light distribution patterns for a low beam and a high beam having a wide range of right and left sides and the brightest central portion can be realized with a simple structure. Therefore, the parabolic reflector 40A can result in an easy design of the plurality of reflex surfaces.

Here, when a distance from the semiconductor light source 20A to a principal point of the imaging lens 30A is defined as A, a distance between the principal point of the imaging lens 30A and the imaging point IPA is defined as B and a focal point distance of the imaging lens 30A is defined as F, a formula (1/A+1/B=1/F) can be justified. Accordingly, when a lens having a short focal point distance is used as the imaging lens 30A, because a distance A+B between the semiconductor light source 20A and the imaging point IPA can become short, the lens having a short focal point distance can result in a miniaturization of the vehicle headlight 1.

As described above, the vehicle headlight 1 can include each of the horizontal curvatures of the reflex surfaces arranged in columns, which can be configured such that the corresponding column light is horizontally extended gradually in a wider range as the corresponding column light approaches from the central column light toward both edge column lights. Accordingly, each of the projecting magnifications in columns of the matrix lights for a low beam and a high beam projected from the reflector can become gradually large as the corresponding column approaches from the central column light toward both edge column lights. Thus, the disclosed subject matter can provide vehicle headlights that can form favorable light distribution patterns for a low beam and a high beam, which include the brightest central portion in a wide range of a smooth light distribution pattern and which can be used for ADB (Adaptive Driving Beam).

In addition, the vehicle headlight 1 can include at least one lighting mode for a headlight for a low beam, a headlight for a high beam, and a daytime running light using the matrix type semiconductor light source 20 as described above. Therefore, the disclosed subject matter can provide reflector type headlights using a matrix type semiconductor light source that can form a favorable light distribution pattern for a low beam without a shade. Furthermore, the vehicle headlight does not require a light source array that uses optical fibers. Thus, the vehicle headlight using the matrix type semiconductor light source can provide favorable light distribution patterns for a low beam and a high beam with a low cost in comparison with the conventional vehicle headlight.

While there has been described what are at present considered to be exemplary embodiments of the invention, it will be understood that various modifications may be made thereto, and it is intended that the appended claims cover such modifications as fall within the true spirit and scope of the invention. All conventional art references described above are herein incorporated in their entirety by reference.

What is claimed is:

1. A vehicle headlight comprising:

a semiconductor light source including a base board, a plurality of semiconductor light-emitting chips, and an encapsulating resin, the plurality of semiconductor light-emitting chips located adjacent the base board and arranged in a matrix so that the plurality of semiconductor light-emitting chips emits a matrix light including a central column light portion and both edge column light portions, wherein the encapsulating resin encapsulates each of the semiconductor light-emitting chips;

an imaging lens having an incoming surface and an outgoing surface, and the incoming surface of the imaging lens is located adjacent the semiconductor light source so that the imaging lens enlarges each elemental portion of light of the matrix light including the central column light portion and both edge column light portions emitted from the semiconductor light source; and a reflector including a plurality of reflex surfaces, the plurality of reflex surfaces located adjacent the outgoing surface of the imaging lens and arranged in a matrix so as to receive each elemental portion of light of the matrix light enlarged by the imaging lens from the outgoing surface of the imaging lens, each of the reflex surfaces having a vertical curvature and a horizontal curvature, and wherein each of the vertical curvatures of the reflex surfaces arranged in rows is substantially the same with respect to each other, each of the horizontal curvatures of the reflex surfaces arranged in columns is configured such that a corresponding column light portion of the matrix light is horizontally extended gradually in a wider range as the corresponding column light approaches from the central column light portion toward both edge column light portions.

2. The vehicle headlight according to claim 1, wherein each of the reflex surfaces of the reflector is configured with a free surface based upon at least one of an arc curved line, a conical curved line, a spline curve, and a Bezier surface.

3. The vehicle headlight according to claim 2, wherein the matrix light emitted from the semiconductor light source includes at least one lighting mode of a headlight for a low beam, a headlight for a high beam, and a daytime running light.

4. The vehicle headlight according to claim 3, wherein the encapsulating resin continuously encapsulates a region of the plurality of semiconductor light-emitting chips configured to provide the at least one lighting mode of a headlight for a low beam, a headlight for a high beam, and a daytime running light.

5. The vehicle headlight according to claim 2, wherein each of the vertical curvatures of the reflex surfaces arranged in rows is configured to convert a corresponding row light portion of the matrix light enlarged by the imaging lens into a substantially parallel light in a vertical direction.

6. The vehicle headlight according to claim 2, wherein a light intensity of the central column light portion reflected on the reflector is thirty times or more a light intensity of both edge column light portions reflected on the reflector.

7. The vehicle headlight according to claim 2, wherein each of the semiconductor light-emitting chips is a blue light-emitting chip and the encapsulating resin includes a wavelength converting material selected from the group consisting of a yellow phosphor and two phosphors including a red phosphor and a green phosphor.

8. The vehicle headlight according to claim 2, wherein each of the semiconductor light-emitting chips is an ultraviolet light-emitting chip and the encapsulating resin includes a wavelength converting material including at least one of a red phosphor, a green phosphor, and a blue phosphor.

9. The vehicle headlight according to claim 2, further comprising:

an outer lens located adjacent the reflector and configured to transmit the matrix light reflected from the reflector; and a casing located adjacent the outer lens so as to cover the reflector, the imaging lens, and the semiconductor light source in conjunction with the outer lens.

10. The vehicle headlight according to claim 1, wherein the matrix light emitted from the semiconductor light source includes at least one lighting mode of a headlight for a low beam, a headlight for a high beam, and a daytime running light.

11. The vehicle headlight according to claim 10, wherein the encapsulating resin continuously encapsulates a region of the plurality of semiconductor light-emitting chips configured to provide the at least one lighting mode of a headlight for a low beam, a headlight for a high beam, and a daytime running light.

12. The vehicle headlight according to claim 1, wherein each of the vertical curvatures of the reflex surfaces arranged in rows is configured to convert a corresponding row light portion of the matrix light enlarged by the imaging lens into a substantially parallel light in a vertical direction.

13. The vehicle headlight according to claim 1, wherein a light intensity of the central column light portion reflected on the reflector is thirty times or more a light intensity of both edge column light portions reflected on the reflector.

14. The vehicle headlight according to claim 1, wherein each of the semiconductor light-emitting chips is a blue light-emitting chip and the encapsulating resin includes a wavelength converting material selected from the group consisting of a yellow phosphor and two phosphors including a red phosphor and a green phosphor.

15. The vehicle headlight according to claim 1, wherein each of the semiconductor light-emitting chips is an ultraviolet light-emitting chip and the encapsulating resin includes a wavelength converting material including at least one of a red phosphor, a green phosphor, and a blue phosphor.

16. The vehicle headlight according to claim 1, further comprising:

an outer lens located adjacent the reflector and configured to transmit the matrix light reflected from the reflector; and a casing located adjacent the outer lens so as to cover the reflector, the imaging lens, and the semiconductor light source in conjunction with the outer lens.

17. A vehicle headlight, comprising:

a semiconductor light source including a base board, a plurality of semiconductor light-emitting chips, and an encapsulating resin, the plurality of semiconductor light-emitting chips located adjacent the base board and arranged in a matrix including a central column and a central row so that the plurality of semiconductor light-emitting chips emits a matrix light including a central column light portion and both edge column light portions, and the encapsulating resin encapsulating each of the semiconductor light-emitting chips;

an imaging lens having an incoming surface, an optical axis, and an imaging point located on the optical axis opposite the incoming surface, the optical axis of the imaging lens intersecting with the central column of the semiconductor light-emitting chips at a substantially right angle with respect to the central row, and the incoming surface of the imaging lens located adjacent the semiconductor light source so that the imaging lens focuses the matrix light including the central column light portion and both edge column light portions emitted from the semiconductor light source at the imaging point; and a parabolic reflector including a horizontal curvature, a reflector optical axis, and a focus located on the reflector optical axis, the focus of the parabolic reflector located substantially at the imaging point of the imaging lens, the reflector optical axis being located on a virtual coplanar surface including the central column of the semiconductor light-emitting chips and the optical axis of the imaging lens, and wherein the horizontal curvature is configured such that a column light portion of the matrix light is horizontally extended gradually in a wider range as the column light portion approaches from the central column light portion toward both edge column light portions.

18. The vehicle headlight according to claim 17, wherein the matrix light emitted from the semiconductor light source includes at least one lighting mode of a headlight for a low beam, a headlight for a high beam, and a daytime running light.

19. The vehicle headlight according to claim 18, wherein the encapsulating resin continuously encapsulates a region of the plurality of semiconductor light-emitting chips configured to provide the at least one lighting mode of a headlight for a low beam, a headlight for a high beam, and a daytime running light.

20. The vehicle headlight according to claim 17, further comprising:

an outer lens located adjacent the reflector and configured to transmit the matrix light reflected from the reflector; and a casing located adjacent the outer lens so as to cover the reflector, the imaging lens, and the semiconductor light source in conjunction with the outer lens.

* * * * *